US010323580B2

(12) United States Patent
Azevedo

(10) Patent No.: US 10,323,580 B2
(45) Date of Patent: Jun. 18, 2019

(54) ISOBARIC PISTON ASSEMBLY

(71) Applicant: Federal-Mogul Corporation, Southfield, MI (US)

(72) Inventor: Miguel Azevedo, Ann Arbor, MI (US)

(73) Assignee: Tenneco Inc., Lakeforest, IL (US)

( * ) Notice: Subject to any disclaimer, the term of this patent is extended or adjusted under 35 U.S.C. 154(b) by 32 days.

(21) Appl. No.: 15/349,820

(22) Filed: Nov. 11, 2016

(65) Prior Publication Data

US 2017/0130656 A1 May 11, 2017

Related U.S. Application Data

(60) Provisional application No. 62/253,746, filed on Nov. 11, 2015.

(51) Int. Cl.
*F02D 15/04* (2006.01)
*F02B 75/04* (2006.01)

(52) U.S. Cl.
CPC ..... *F02D 15/04* (2013.01); *F02B 75/044* (2013.01)

(58) Field of Classification Search
CPC ..... F02B 75/044; F02B 75/04; F02D 15/00; F02F 3/00
See application file for complete search history.

(56) References Cited

U.S. PATENT DOCUMENTS 3,038,458 A * 6/1962 Mansfield ..... F02B 75/044 123/668
3,200,798 A * 8/1965 Mansfield ..... F02B 75/044 123/48 B
3,417,739 A * 12/1968 Fryer ..... F02B 75/044 123/78 R
3,450,112 A * 6/1969 Bachle ..... F02B 25/00 123/48 R
3,656,412 A * 4/1972 Wilson ..... F02B 75/044 123/48 B
5,029,562 A * 7/1991 Kamo ..... F02F 3/0023 123/193.6
5,755,192 A * 5/1998 Brevick ..... F02B 75/044 123/78 B
7,066,118 B2 * 6/2006 Hirano ..... F02B 75/044 123/48 B
7,637,241 B2 * 12/2009 Styron ..... F02B 75/044 123/193.6
2006/0005793 A1 * 1/2006 Ward ..... F02B 75/04 123/48 B (Continued)

*Primary Examiner* — Long T Tran
(74) *Attorney, Agent, or Firm* — Robert L. Stearns; Dickinson Wright PLLC

(57) ABSTRACT

A power cylinder assembly for an internal combustion engine includes a cylinder wall that surrounds a cylinder bore that extends along an axis. A piston assembly is positioned in the cylinder bore, and the piston assembly has a combustion surface that divides the cylinder bore into a combustion chamber on one axial side of the combustion surface and a crank case on an opposite axial side of the combustion surface. The combustion surface is partially defined by a first upper surface of a first piece and partially defined by a second upper surface of a second piece. The second piece is moveable relative to the piston body during operation of the power cylinder assembly to change a compression ratio of the power cylinder assembly.

12 Claims, 4 Drawing Sheets

(56) References Cited

U.S. PATENT DOCUMENTS

| | | | | |
|---|---|---|---|---|
| 2006/0090715 | A1* | 5/2006 | Kondo | F02B 75/044 123/48 B |
| 2009/0107447 | A1* | 4/2009 | Styron | F02B 75/044 123/193.6 |
| 2011/0192370 | A1* | 8/2011 | Wang | F02B 75/044 123/193.6 |
| 2012/0227705 | A1* | 9/2012 | Ashizawa | F02B 75/044 123/435 |
| 2015/0252750 | A1* | 9/2015 | Galvin | F02F 3/0015 123/193.6 |

* cited by examiner

| | | | |
|---|---|---|---|
| Say: | | | |
| $E_0$ | | 18 | :1 |
| Max plunger travel | | 50 | mm |
| Isobaric control range | | 200 to 250 | bar |
| Vcc at 18:1 | | 1.50E-04 | $m^3$ |
| Vs of 14.8 l./6 cyl. | | 2.47E-03 | $m^3$ |
| Polytropic Vol Increase at n=1.35 (250 down to 200 bar) | | 1.17973698 | |
| Diam. of Plunger (mm) | % of Φ | | ε*:1 |
| 20 | 14.4 | 1.5708E-05 | 15.9 |
| 25 | 18.0 | 2.4544E-05 | 15.2 |
| 30 | 21.6 | 3.5343E-05 | 14.3 |
| 35 | 25.2 | 4.8106E-05 | 13.5 |
| 40 | 28.8 | 6.2832E-05 | 12.6 |
| 45 | 32.4 | 7.9522E-05 | 11.8 |
| 50 | 36.0 | 9.8175E-05 | 11.0 |

ISOBARIC PISTON ASSEMBLY

CROSS-REFERENCE TO RELATED APPLICATION

This U.S. patent application claims priority to U.S. Provisional Patent Application No. 62/253,746, filed Nov. 11, 2015 and entitled "Isobaric Piston Assembly," the entire disclosure of this application being considered part of the disclosure of this application and hereby incorporated by reference.

BACKGROUND OF THE INVENTION

1. Field of the Invention

The present invention is related to pistons for power cylinder assemblies of internal combustion engines.

2. Related Art

There is a continuing desire to increase power density (power per unit volume of displacement) of internal combustion engines to maximize power while minimizing packaging size and mass. One approach some engine manufacturers have taken to reduce packaging size and mass is to reduce the wall thicknesses of various components in the engine including, for example, the cylinder head and the engine block. However, in order to avoid damaging the engine during use, these components must remain sufficiently strong to resist combustion gas pressures within the combustion chambers of the engine. Therefore, in engines with a fixed compression ratio, the compression ratio must be specifically set so as to avoid damaging the engine, but this may compromise the performance of the engine during certain times, such as during start-up of the engine, when a higher compression ratio would be desirable.

There remains a continuing need for a high power density engine which has a variable compression ratio so as to optimize the performance of the engine during a wider range of operating conditions.

SUMMARY OF THE INVENTION AND ADVANTAGES

One aspect of the present invention provides for a power cylinder assembly for an internal combustion engine which includes a cylinder wall that surrounds a cylinder bore that extends along an axis. A piston assembly is positioned in the cylinder bore, and the piston assembly has a combustion surface that divides the cylinder bore into a combustion chamber on one axial side of the combustion surface and a crank case on an opposite axial side of the combustion surface. The combustion surface is partially defined by a first upper surface of a first piece and partially defined by a second upper surface of a second piece. The second piece is moveable relative to the piston body during operation of the power cylinder assembly to change a compression ratio of the power cylinder assembly.

The power cylinder assembly according to this aspect of the present invention is advantageous because it allows for an engine with a reduced package size and reduced mass in addition to improved performance by allowing the power cylinder assembly to operate at a high compression ratio in certain operating conditions and allowing it to operate at a low compression ratio at other operating conditions. The power cylinder assembly automatically switches between the high and low compression ratios without any external input. For example, the power cylinder can operate with a high compression ratio when the engine is cold or operating in a low power demand condition to maximize engine efficiency and fuel mileage. The power cylinder assembly also can operate at a relatively lower compression ratio when increased power is demanded. The lower compression ratio also may protect the engine from damage that could otherwise occur from high combustion pressures.

According to another aspect of the present invention, the first piece is a piston body, and the second piece is a part of a plunger assembly.

According to yet another aspect of the present invention, the plunger assembly is biased into a resting position by a spring and is moveable relative to the piston body in response to a pressure force in the combustion chamber overcoming a biasing force by the spring.

According to still another aspect of the present invention, the plunger assembly includes a plunger cusp which defines a portion of the combustion surface.

According to a further aspect of the present invention, the piston body presents an inner wall which surrounds a through passage and wherein the plunger assembly is slidably disposed in the through passage and is sealed against the inner wall to restrict the passage of combustion gasses past the plunger assembly.

According to yet a further aspect of the present invention, the plunger assembly further includes a sealing element which is sealed against the inner wall of the piston body.

According to still a further aspect of the present invention, the inner wall partially defines an oil gallery on an opposite radial side of the inner wall from the through passage.

According to another aspect of the present invention, the combustion surface includes a combustion bowl which is partially defined by the piston body and partially defined by the plunger assembly.

According to yet another aspect of the present invention, the piston body is made as a single, integral piece.

Another aspect of the present invention is related to a method of operating a power cylinder assembly in an internal combustion engine. The method includes the step of providing a power cylinder assembly which includes a cylinder bore and a piston assembly disposed in the cylinder bore, the piston assembly presenting a combustion surface which separates the cylinder bore into a combustion chamber on one axial side of the combustion surface and a crank case on an opposite axial side of the crank case, and the combustion surface being partially defined by a first upper surface of a first piece and partially defined by a second upper surface of a second piece. The method continues with the step of, during a combustion stroke, maintaining the second upper surface of the second piece in a fixed position relative to the first upper surface of the first piece to provide the power cylinder assembly with a compression ratio in response to pressures of combustion gasses in the combustion chamber being below a predetermined threshold pressure. The method proceeds with the step of, during another combustion stroke, moving the second upper surface of the second piece relative to the first upper surface of the first piece to expand the combustion chamber and reduce the compression ratio of the power cylinder assembly in response to pressures of the combustion gasses in the combustion chamber reaching the predetermined threshold pressure.

BRIEF DESCRIPTION OF THE DRAWINGS

These and other features and advantages of the present invention will be readily appreciated, as the same becomes better understood by reference to the following detailed description which considered in connection with the accompanying drawings wherein.

DETAILED DESCRIPTION OF THE ENABLING EMBODIMENT

Figure 1:
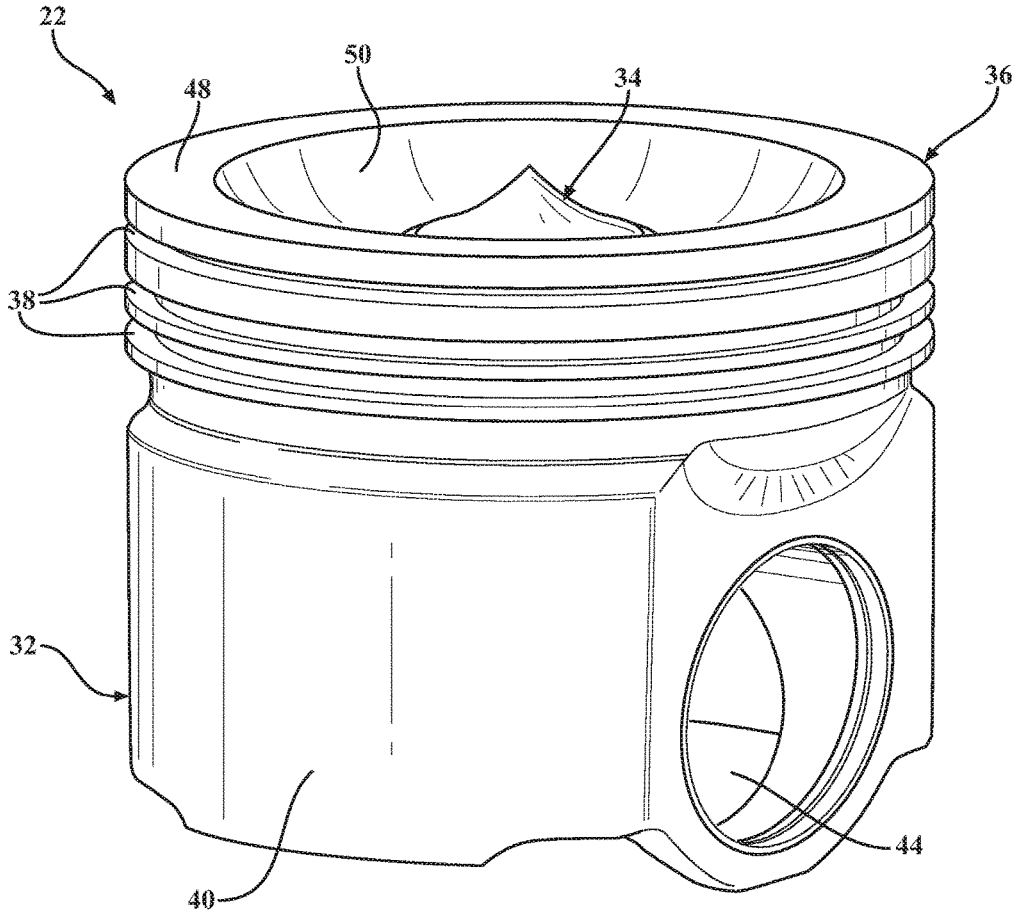
FIG. 1 is an isometric view of a piston assembly constructed according to one aspect of the present invention.
Figure 2:
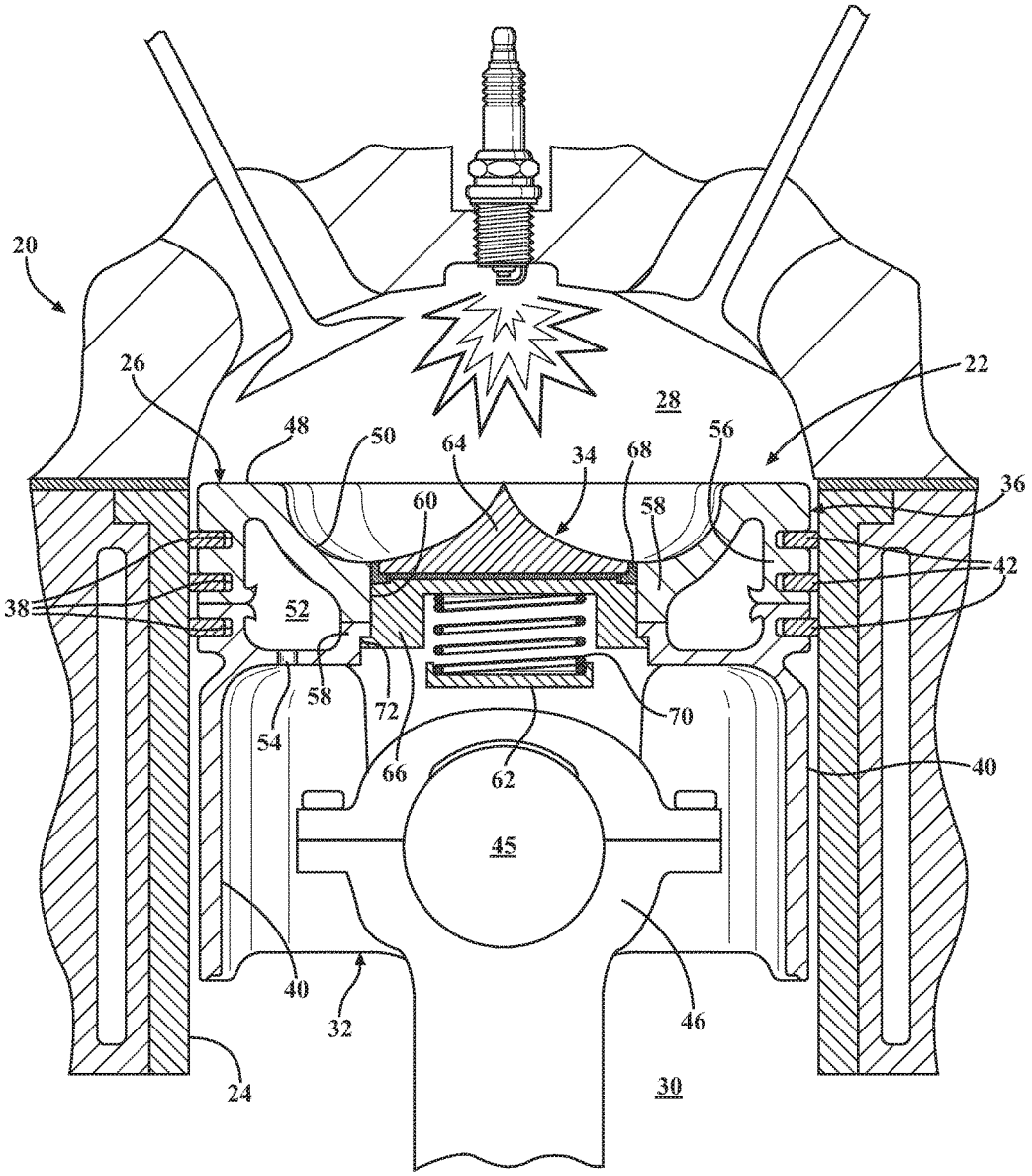
FIG. 2 is a cross-sectional view of a power cylinder assembly during a combustion stroke and wherein a plunger assembly within a piston assembly is in a first position.
Figure 3:
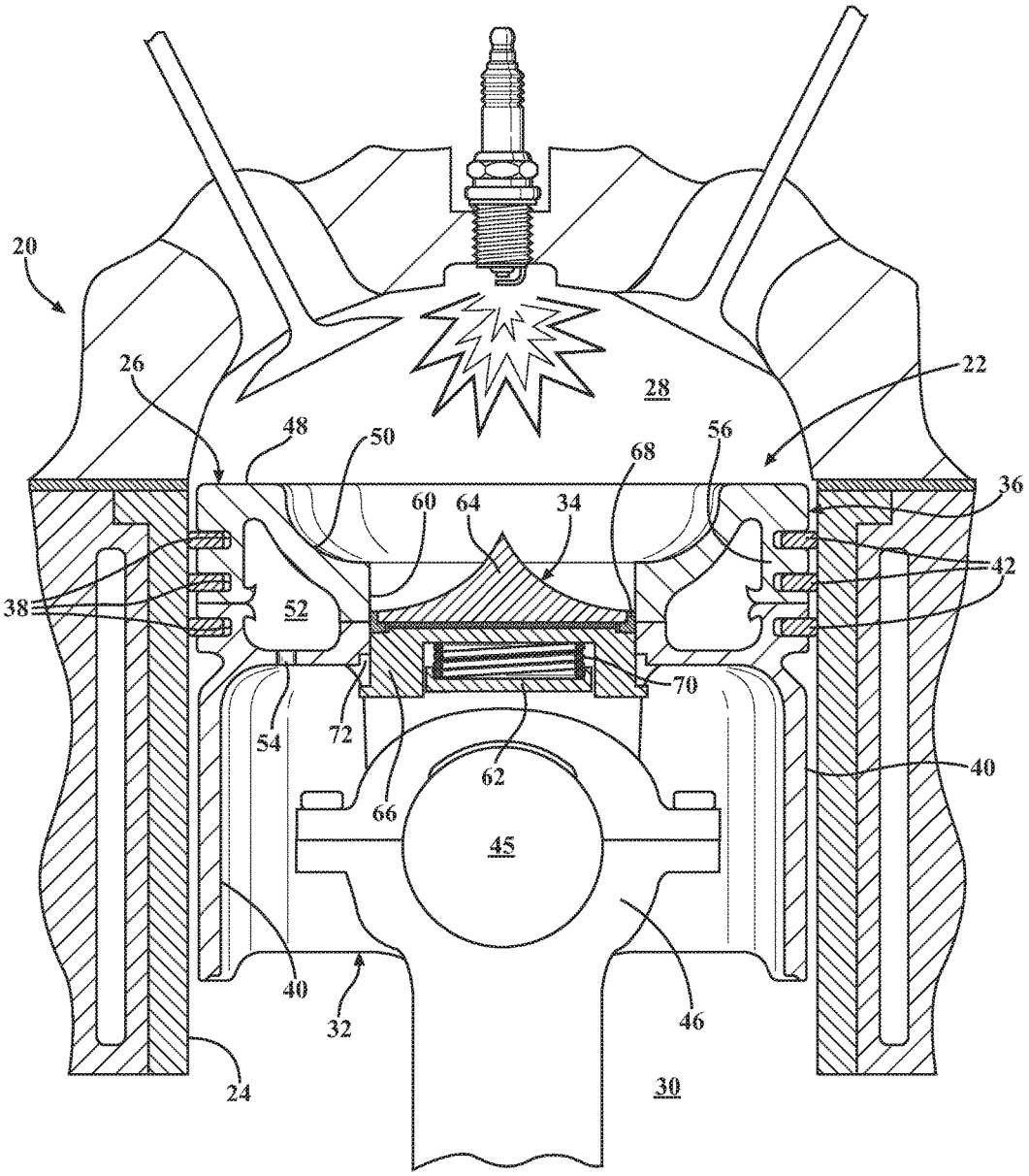
FIG. 3 is a cross-sectional view of a power cylinder assembly during a combustion stroke and wherein a plunger assembly within a piston assembly is in a second position.

Referring to the Figures, wherein like numerals indicate corresponding parts throughout the several views, an exemplary embodiment of an improved power cylinder assembly 20 for an in internal combustion engines is generally shown in FIGS. 2 and 3. The improved power cylinder assembly 20 has an automatically adjustable a compression ratio by modifying a volume of the combustion chamber when the piston is at or near top dead center between the compression and combustion (power) strokes of a conventional four stroke power cycle to maintain combustion pressures below a predetermined threshold pressure. The power cylinder assembly 20 may be easily tuned to prevent the pressure of the combustion gasses in the combustion chamber from exceeding a predetermined threshold pressure by simply altering or selecting certain components of a piston assembly 22 that is positioned in a cylinder bore 24 of the power cylinder assembly 20. The piston assembly 22 of the exemplary embodiment is particularly suited for use in diesel fueled engines with a high power density (power per unit volume). However, it should be appreciated that the piston assembly 22 could find uses in a range of different types of internal combustion engines including engines with both four and two stroke power cycles and gasoline and diesel fueled engines.

Referring now to FIG. 2, the exemplary embodiment of the piston assembly 22 is shown in a cylinder bore 24, which extends along an axis, at approximately a top-dead-center position. The piston assembly 22 presents a combustion surface 26 which separates the cylinder bore 24 into a combustion chamber 28 on one axial side of the combustion surface 26 and a crank case 30 on an opposite axial side of the combustion surface 26. The combustion surface 26 is partially defined by an upper surface of a piston body 32 and partially defined by an upper surface of a plunger assembly 34.

In the exemplary embodiment, the piston body 32 is a single piece of metal (such as steel or a steel alloy). The piston body 32 includes a crown 36 with an upper surface and an annular ring belt with a plurality of circumferentially extending grooves 38 that are spaced axially from one another. A plurality of piston rings 42 are disposed in the grooves 38 and are biased into contact with a wall of the cylinder bore 24 to seal the piston body 32 with the wall as the piston assembly 22 reciprocates up and down within the cylinder bore 24 during operation of the engine. The exemplary embodiment of the piston body 22 additionally includes a pair of diametrically opposed skirt portions 40 for guiding the reciprocating movement of the piston assembly 22 in the cylinder bore 24 and a pair of co-axially aligned pin bosses with pin bores 44 for receiving a wrist pin 45 which connects the piston assembly 22 with a connecting rod 46.

The upper surface of the crown portion 36 has an annularly shaped and generally planar portion 48 and a combustion bowl 50 which is recessed relative to the generally planar portion 48. The crown 36 further includes a semi-enclosed and annularly shaped cooling gallery 52 that is spaced radially inwardly of the ring grooves 38 for receiving a cooling oil to cool the crown 36 during operation of the engine. Specifically, the exemplary cooling gallery 52 includes a plurality of circumferentially spaced ports 54 that receive the cooling oil into the cooling gallery 52 and allow the cooling oil to escape the cooling gallery 52 and fall down into the crank case 30. The cooling gallery 52 is formed into the piston body 32 by joining two separately made pieces of the piston body 32 together on opposite radial sides of the cooling gallery 52. Each of the two pieces includes a circumferentially extending outer wall 56 and a circumferentially extending inner wall 58 that is spaced radially inwardly from the outer wall 56. The outer walls 56 are joined together to provide the piston body 32 with a single outer wall 56, and the inner walls 58 are joined together to provide the piston body 32 with a single inner wall 58. The outer and inner walls 56, 58 could be joined together through, for example, friction welding or induction welding.

The inner wall 58 of the piston body 32 has an inner surface that surrounds a cylindrically shaped inner chamber 60 (or through passage) which opens to the combustion chamber 28 in one axial direction and towards the crank case 30 in an opposite axial direction. The inner chamber 60 is generally centrally located in the piston body 32 in a radial direction. The piston body 22 also presents a shelf 62 which is located axially below the inner chamber 60 and above the pin bosses. In the exemplary embodiment, the shelf 62 is made integrally with the piece of the piston body 32 that includes the pin bosses and the skirt portions 40.

The plunger assembly 34 is disposed in the inner chamber 60 of the piston body 32 and is movable relative to the piston body 32 in the axial direction during operation of the engine to expand and contract a volume of the combustion chamber 28. In the exemplary embodiment, the plunger assembly 34 includes a plunger cusp 64, a plunger body 66, a sealing ring 68, and a spring 70. The plunger cusp 64 has an upper surface which completes the combustion bowl 50 of the combustion surface 26. The plunger body 66 is bonded with a lower surface of the plunger cusp 64 and has a skirt that extends axially towards the crank case 30. The sealing ring 68 is a dykes-type ring 68 that has an L-shaped cross-section and is disposed in a ring groove in the plunger body 66 for sealing the plunger assembly 34 against the inner wall 58 of the piston body 32. The dykes-type ring 68 is a so-called zero tangential tension spring in that it is configured to exert a very low tension force against the inner wall 58 of the piston body 32 during the intake, compression and exhaust strokes of the power cycle, but during the combustion stroke, pressurized combustion gasses can flow into a convoluted space between the sealing ring 68 and the piston body 32 to force the sealing ring 68 out against the inner wall 58 and seal the combustion gasses in the combustion chamber 28. As such, the friction is minimized during three of the strokes without compromising the sealing ring's 68 ability to seal combustion gasses in the combustion chamber 28. This increases the durability, efficiency and operating life of the piston assembly 22. Additionally, the sealing ring 68 functions to impede the flow of oil upwardly from the crank case 30 below the piston assembly 22 to the combustion chamber 28 above the piston assembly 22. In the exemplary embodiment, only one sealing ring 68 is employed to seal the plunger assembly 34 with the piston body 32. However, it should be appreciated that any suitable number of sealing rings may be employed.

The plunger assembly 34 is biased by the spring 70 against a stopper 72 into a first position, which is shown in FIG. 2, within the inner chamber 60 wherein the upper surface of the plunger cusp 64 is generally flush with the upper surface of the piston body 32 to complete the combustion bowl 50. In the exemplary embodiment, the stopper 72 is a counterbore in the inner wall 58 of the piston body, and the plunger body 66 presents a radially outwardly extending flange for contacting the stopper 72 to hold the plunger assembly 34 in the first position. The spring 70 is a compression spring which contacts a first spring seat on the plunger body 66 and a second spring seat on the shelf 62. It should be appreciated that the stopper 72 may take a range of different configurations for establishing the first position of the plunger assembly 34. Rather than a compression spring 70, the biasing means for biasing the plunger assembly 34 towards the first position could be, for example, with hydraulic pressure that is sourced from the engine.

During operation, when the fuel and air mixture is ignited within the combustion chamber 28 of the piston body 22 during a compression stroke of the piston assembly 20, if the pressure in the combustion chamber 28 exceeds a predetermined threshold pressure established, at least partially, by the stiffness of the spring 70, then the pressure exerts a downward force on the plunger assembly 34 which overcomes the biasing force from the spring 70 to urge the plunger assembly 34 downwardly. This downward movement expands the volume of the combustion chamber 28 to maintain the pressure in the combustion chamber 28 at the predetermined threshold pressure and protect the engine from damage that could result from excessive pressures in the combustion chamber 28. Increasing the stiffness of the spring 70 increases the predetermined threshold pressure, and reducing the stiffness of the spring 70 reduces the predetermined threshold pressure. The compression ratio (ε) of the engine and the change in combustion chamber volume due to plunger travel ($\Delta V_i$) may be calculated as functions of the plunger diameter ($\varnothing_i$) and the plunger travel distance ($\gamma_i$) according to the following equations with $\gamma_i$ having a maximum value of 50 mm. FIG. 3 shows the plunger assembly 34 in a second position with a maximum combustion chamber 28 volume.

$$e = 1 + \frac{2.47 * 10^{-3}}{(1.5 * 10^{-4} + DV_i)} \quad \text{Equation 1}$$

$$DV_i = \frac{p}{4} * f_i^2 * g_i \quad \text{Equation 2}$$

Figures 4A, 4B:
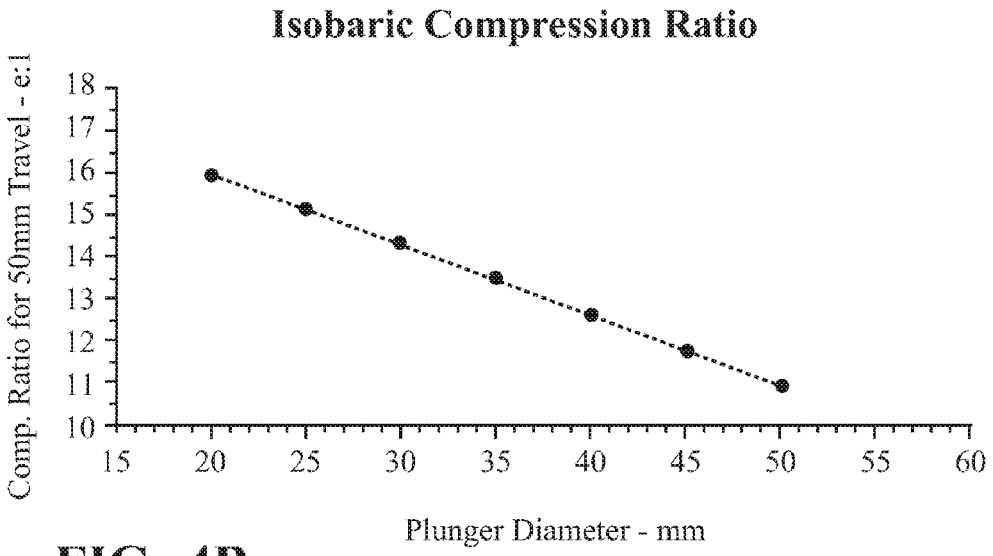
FIG. 4A is a table comparing a change in compression ratio against a diameter of a plunger for a given amount of travel of the plunger assembly.
FIG. 4B is a plot showing the data of the table shown in FIG. 4A.

The piston assembly 22 advantageously allows for a variable compression ratio during operation of the engine. For example, the piston assembly 22 allows for a relatively high compression ratio (with the plunger assembly 34 in the first position shown in FIG. 4) during start-up (cold) operating conditions of the engine and during times when less power is demanded. Then, when greater power is demanded, the plunger assembly 34 is automatically urged downwardly to expand the combustion chamber 28 and reduce the compression ratio during the combustion strokes to allow the engine to produce increased power without exceeding the predetermined threshold pressure in the combustion chamber 28. The predetermined threshold pressure can be easily established by selecting a compression spring 70 with an appropriate stiffness.

Another aspect of the present invention is related to a method of operating a power cylinder assembly 20, such as the power cylinder assembly shown in FIGS. 2 and 3 and discussed above. The method includes the step of, during a combustion stroke, maintaining an upper surface of the plunger cusp 64 in a fixed position relative to an upper surface of the piston body 32 to provide the power cylinder assembly 20 with a compression ratio in response to pressures of combustion gasses in the combustion chamber 28 being below a predetermined threshold pressure. The method proceeds with the step of, during another combustion stroke, moving the upper surface of the plunger cusp 64 relative to the upper surface of the piston body 32 to expand the combustion chamber 28 and reduce the compression ratio of the power cylinder assembly 20 in response to pressures in of the combustion gasses in the combustion chamber 28 reaching the predetermined threshold pressure.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A power cylinder assembly for an internal combustion engine, comprising:
   - a cylinder wall surrounding a cylinder bore that extends along an axis;
   - a piston assembly positioned in said cylinder bore and presenting a combustion surface which separates said cylinder bore into a combustion chamber on one axial side of said combustion surface and a crank case on an opposite axial side of said combustion surface and said combustion chamber having a volume;
   - said combustion surface being partially defined by a first upper surface of a first piece and partially defined by a second upper surface of a second piece;
   - a mechanical coil spring engaging said second piece and being compressed to apply a biasing force on said second piece in a direction towards said combustion chamber; and
   - said second piece being moveable downward relative to said first piece during operation of said power cylinder assembly in response to a pressure in said combustion chamber reaching a predetermined threshold pressure such that a pressure force acting on said second piece exceeds said biasing force of said mechanical coil spring to increase said volume of said compression chamber.

2. The power cylinder assembly as set forth in claim 1 wherein said first piece is a piston body and said second piece is a part of a plunger assembly.

3. The power cylinder assembly as set forth in claim 2 wherein said plunger assembly includes a plunger cusp which defines a portion of said combustion surface.

4. The power cylinder assembly as set forth in claim 3 wherein said piston body presents an inner wall which surrounds a through passage and wherein said plunger assembly is slidably disposed in said through passage and is sealed against said inner wall to restrict the passage of combustion gasses past said plunger assembly.

5. The power cylinder assembly as set forth in claim 4 wherein said plunger assembly further includes a sealing element which is sealed against said inner wall of said piston body.

6. The power cylinder assembly as set forth in claim 4 wherein said inner wall partially defines an oil gallery on an opposite radial side of said inner wall from said through passage.

7. The power cylinder assembly as set forth in claim 1 wherein said first upper surface includes a planar portion and a combustion bowl recessed from and integral with said planner portion.

8. A method of operating a power cylinder assembly in an internal combustion engine, comprising the steps of:

providing a power cylinder assembly which includes a cylinder bore and a piston assembly disposed in the cylinder bore, the piston assembly presenting a combustion surface which separates the cylinder bore into a combustion chamber that has a volume on one axial side of the combustion surface and a crank case on an opposite axial side of the combustion surface, the combustion surface being partially defined by a first upper surface of a first piece and partially defined by a second upper surface of a second piece, and the power cylinder assembly including a mechanical coil spring engaging the second piece and being compressed to apply a biasing force on the second piece to disposed in said second piece for providing a biasing force to said second upper surface;

during a combustion stroke, maintaining by the mechanical coil spring the second upper surface of the second piece in a fixed position relative to the first upper surface of the first piece to provide the power cylinder assembly with a compression ratio in response to pressures of combustion gasses in the combustion chamber being below a predetermined threshold pressure; and during another combustion stroke, moving the second upper surface of the second piece downward relative to the first upper surface of the first piece to increase the volume of the combustion chamber and reduce the compression ratio of the power cylinder assembly in response to a pressure force in the combustion chamber reaching the predetermined threshold pressure to overcome the biasing force from the mechanical coil spring.

9. The method as set forth in claim 8 wherein the first piece is a piston body and the second piece is a part of a plunger assembly.

10. The method as set forth in claim 9 wherein the piston body presents an inner wall which surrounds a through passage and wherein the plunger assembly is slidably disposed in the through passage and is sealed against the inner wall to restrict the passage of combustion gasses past the plunger assembly.

11. The method as set forth in claim 10 wherein the inner wall partially defines an oil gallery on an opposite radial side of the inner wall from the through passage.

12. The method as set for in claim 10 wherein said first upper surface includes a planar portion and a combustion bowl recessed from and integral with said planner portion.

* * * * *